US006516927B2

(12) United States Patent
Krulik

(10) Patent No.: US 6,516,927 B2
(45) Date of Patent: Feb. 11, 2003

(54) CASE WITH INTERNAL FILE POCKETS AND SIDEWALL ACCESS

(75) Inventor: Richard J. Krulik, Dix Hills, NY (US)

(73) Assignee: United States Luggage, L.P., Happauge, NY (US)

( * ) Notice: Subject to any disclaimer, the term of this patent is extended or adjusted under 35 U.S.C. 154(b) by 0 days.

(21) Appl. No.: 09/804,426

(22) Filed: Mar. 12, 2001

(65) Prior Publication Data

US 2002/0125091 A1 Sep. 12, 2002

(51) Int. Cl.[7] ..... A95G 3/00
(52) U.S. Cl. ..... 190/114; 190/902; 150/114
(58) Field of Search ..... 190/114, 101, 190/102, 103, 108–113, 10, 902; 224/275, 236, 237; 238/31, 66, 87, 86.2; 150/113, 114, 115, 116

(56) References Cited

U.S. PATENT DOCUMENTS 3,904,003 A * 9/1975 Margerum ..... 190/11
3,912,055 A * 10/1975 Malooly ..... 219/130.1
5,265,719 A * 11/1993 Wand ..... 190/109
5,881,934 A * 3/1999 Hung ..... 190/109
5,967,270 A * 10/1999 Shyr ..... 190/109
6,105,763 A * 8/2000 Saetia ..... 190/102

* cited by examiner

*Primary Examiner*—Stephen P. Garbe
*Assistant Examiner*—Lien Ngo
(74) *Attorney, Agent, or Firm*—Abelman, Frayne & Schwab

(57) ABSTRACT

A case for carrying papers or the like includes a top closure member that is movable between a first open position, a second open position at which a top opening exists permitting access to the interior of the case and a first closed position at which the top opening does not exist. A side closure member releasably secures a sidewall portion vertically in a second closed position, and the side closure member is openable to permit movement of the sidewall portion from its second closed position to a third open position at which a side opening exists permitting access to the interior, where opening of the side closure member is independent of a position of the top closure member.

24 Claims, 2 Drawing Sheets

FIG. 1
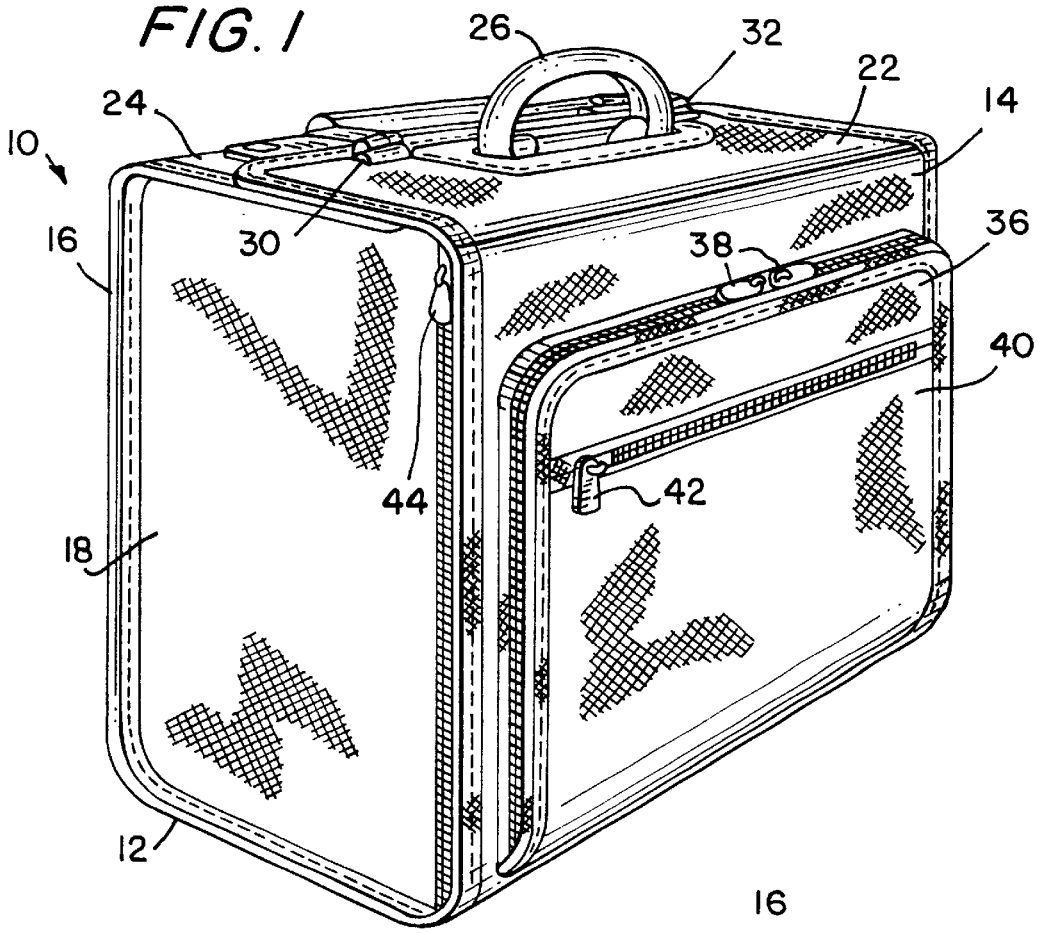
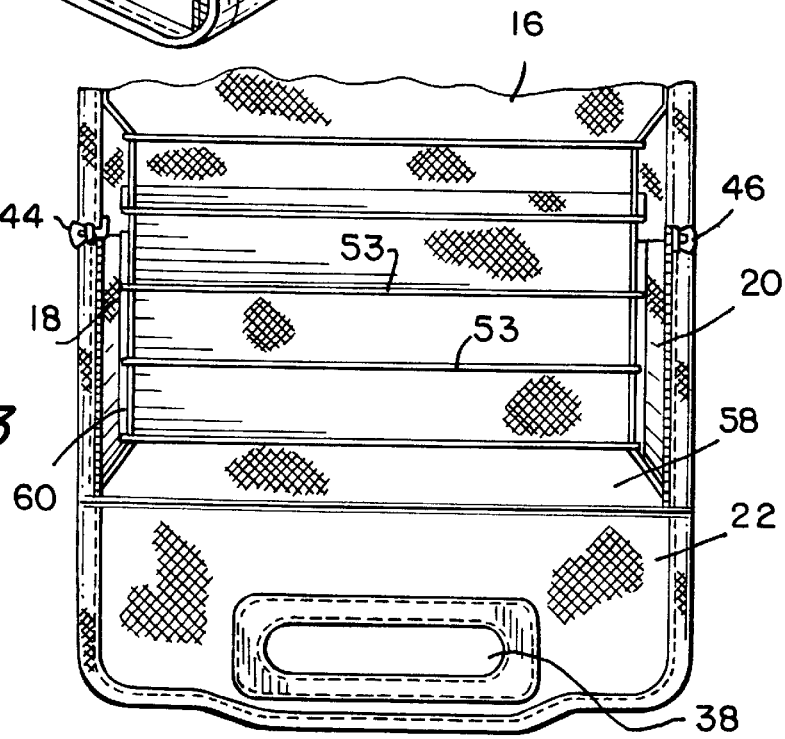
FIG. 3

CASE WITH INTERNAL FILE POCKETS AND SIDEWALL ACCESS

FIELD OF THE INVENTION

This invention relates to cases for holding papers or the like, and more particularly to carrying cases, such as briefcases, for holding papers or the like to which easy access is desirable.

BACKGROUND OF THE INVENTION

Carrying cases for holding papers, files or the like, such as briefcases, are often sized to accommodate a large number of papers, which may be advantageously sorted into the pockets of an internal file folder for relatively easy reference. Examples of such cases are the salesman's case and the litigation bag, or "lit bag" used by lawyers to carry legal papers from one office to another or to court. Frequently such cases are constructed to open from the top, using a zipper, a buckle strap or top flaps that fold over one another, and access to the papers in the case can only be achieved by fully opening the top closure. While this construction is perfectly acceptable when the desire is to access all of the papers in the case, it is less than convenient when it is desired to obtain only one or a few papers, as, for example, during travel on an airplane or train when a particular document is to be reviewed or worked on. In such situations, it is often difficult, or even impossible, to find the space to filly open the case and sort through all the papers, especially without bothering the person in the next seat.

One other difficulty in opening the case from the top closure under these circumstances is that the files and papers are held vertically in the case, making it harder to see and identify each paper or file, especially if the case is relatively full. Of course, it is possible to tip the case over on its side, but this is often unwieldy with a large case and presents the problem that the papers can spill out.

Some cases have attempted to overcome this problem by adding a separate smaller side pocket on one outside wall of the case. While such a pocket will hold a smaller number of papers, these papers can only be accessed by opening the separate closure member, for example, a zipper or flap, of the pocket. Accordingly, the user may have to both open the top closure of the case and the closure of the exterior side pocket in order to get all the papers needed.

The prior art has still not found a construction for such a case that provides easy access to the desired papers under all of the above circumstances.

Accordingly, it is an object of the present invention to provide a case that avoids the above-noted difficulties of the prior art.

It is a further object of the present invention to provide a case for carrying papers or the like that provides access to the interior of the case without requiring that the top closure of the case be fully opened.

It is yet a further object of the present invention to provide a carrying case for carrying papers or the like that provides access to the interior at a side of the case as well as at the top of the case.

It is another object of the present invention to provide a case for carrying papers or the like that provides access to papers in the interior of the case such that the papers are presented at an angle while the case remains upright.

SUMMARY OF THE INVENTION

The above objects, as well as additional advantages, will be realized in the practice of the invention as herein described. In a broad embodiment, the case comprises a member having a bottom, a sidewall portion extending upwardly at a first side of the bottom, and first and second endwalls extending upwardly from second and third opposite sides of the bottom. A top closure member extends along a direction of a top edge of the sidewall portion and is movable between an open position forming a top opening providing access to the interior of the case and a closed position closing the top opening. A side closure member releasably secures the sidewall portion along a direction of a first side edge of the first endwall adjacent the sidewall portion and along a direction of a second side edge of the second endwall adjacent the sidewall portion in a closed position thereof. The side closure member is movable to an open position for permitting movement of the sidewall portion from its closed position to an open position at which a side opening provides access to the interior of the case, the side closure member being movable independently of a position of the top closure member.

In another embodiment, a case in accordance with the present invention has two sides, two ends, a top and a bottom, and comprises a member having a bottom, first and second sidewalls extending upwardly from first and second opposite sides of the bottom, and first and second endwalls extending upwardly from third and fourth opposite sides of the bottom, the member forming the bottom, sides and ends of the case. A first top flap extends pivotally from a top edge of the first sidewall and is movable between an open position and a closed position, and a second top flap extends pivotally from a top edge of the second sidewall and is movable between an open position and a closed position. The first and second top flaps form the top of the case, where when the first and second top flaps are in their respective open positions, a top opening at the top of the case permits access to an interior of the case, and when the first and second top flaps are in their respective closed positions, the first and second top flaps prevent access to the interior. A closure member releasably secures the first sidewall to a first side edge of the first endwall adjacent the first sidewall and to a second side edge of the second endwall adjacent the first sidewall in a closed position of the first sidewall. The closure member is movable to an open position for permitting movement of the first sidewall to an open position forming a side opening providing access to the interior of the case when the first top flap is in its open position, movement of the first sidewall being permitted independently of a position of the second top flap.

Advantageously, the first sidewall (or sidewall portion) forms an outer wall of a bellows or accordion file organizer within the interior, the bellows file being accessible through both the top and side openings when their respective closure members are open. When the side wall is opened, the bottom portion of the bellow file dividers remain for the most part in their original position and the top or upper openings are spread apart. In the open position, the bellows file dividers then constitute slanted surfaces upon which papers in their interior are presented at an angle between horizontal and vertical, thereby permitting easy inspection, selection and removal.

These and other objects, features and aspects of the present invention will be apparent from the following description of the preferred embodiments taken in conjunction with the attached drawings.

BRIEF DESCRIPTION OF THE DRAWINGS

The invention will be further described with reference to the drawings in which like elements are represented by the same number.

FIG. 1 is a perspective view of an embodiment of a case of the present invention with all closure members closed.

FIG. 3 is a top view of the case of FIG. 2 taken in the direction of arrows 3 in FIG. 2.

DETAILED DESCRIPTION OF THE PREFERRED EMBODIMENTS

Figure 2:
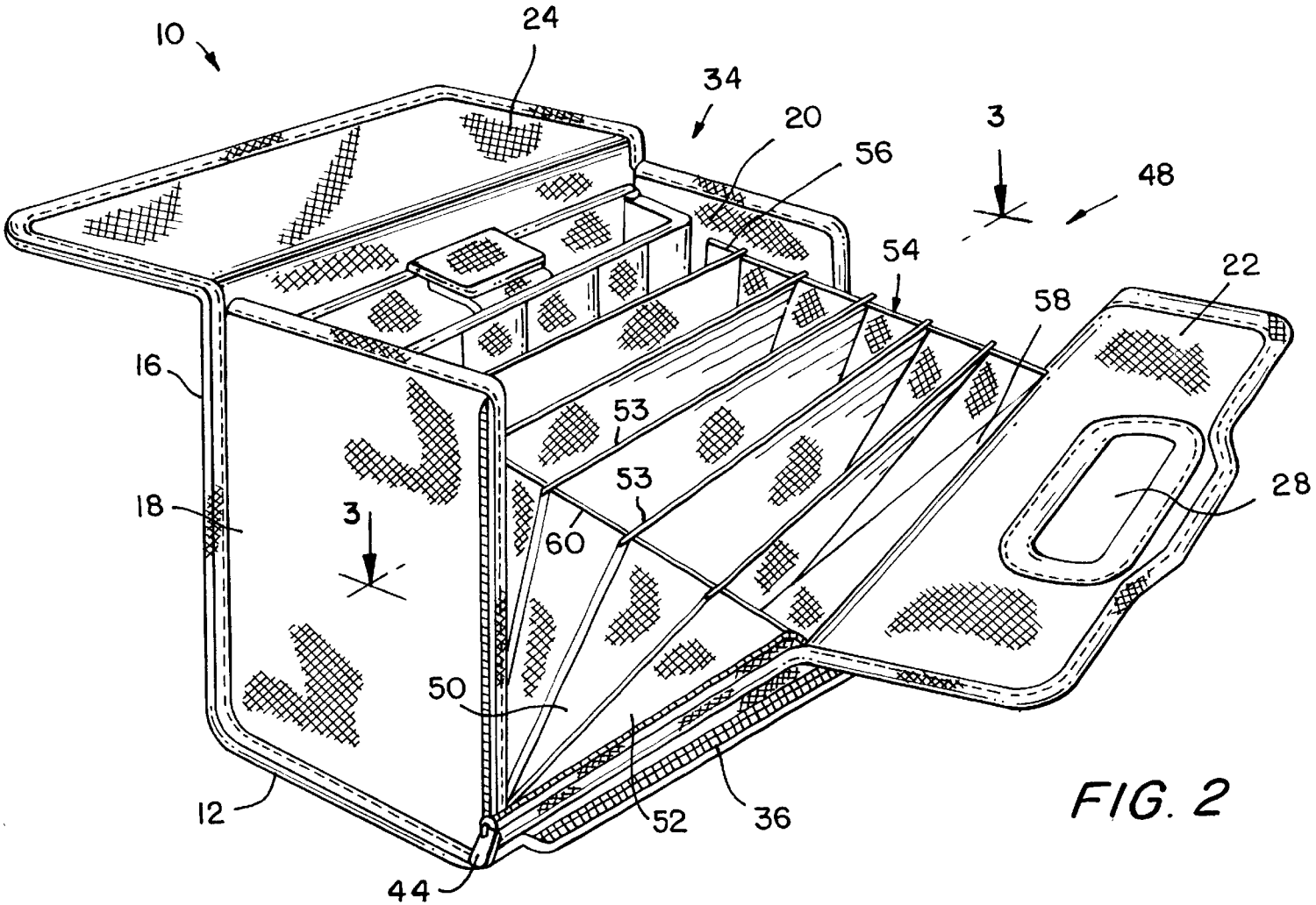
FIG. 2 is a side perspective view of the case of FIG. 1 with both a top closure member and a side closure member open.

With reference to FIG. 1, a case in accordance with the present invention is embodied in a carrying case 10 having a bottom 12, a first sidewall 14, a second sidewall 16, a first endwall 18 and a second endwall 20 (see FIG. 3). The top of the case 10 is formed by a first top flap 22, extending integrally from a top edge of the first sidewall 14 and a second top flap 24 extending integrally from a top edge of the second sidewall 16. In FIG. 1, the first and second top flaps are shown in their closed position, with the second top flap 24 having been pivoted down to lie across a portion of the top surface of the case 10 and the first top flap 22 having been pivoted down to lie across the remaining portion of the top surface and to overlap part of the second top flap 24. The second top flap 24 carries a handle 26 that extends through an opening 28 in the first top flap 22. Clasps 30, 32 serve to lock the first top flap 22 to the second top flap 24 to hold them closed so that the case 10 may be secured and carried. Together, at least the first top flap 22 and the second top flap 24 form a top closure member for the case 10.

As shown in FIG. 3, when the first and second top flaps 22, 24 are pivoted up and back to their respective open positions, a top opening 34 is present at the top of the case 10 through which the interior of the case 10 may be accessed to reach any papers or other materials therein.

Referring again to FIG. 1, there is shown attached to the outside of the first sidewall 14 is an optional side pocket 36 of conventional design that uses a complementary pair of zippers 38 to be opened and closed, and at the outside of the side pocket 34 is a further conventional side pocket 40 that is opened and closed by a zipper 42.

In accordance with an advantageous aspect of the present invention, the first sidewall 14 is not permanently attached to the first and second endwalls 18, 20. Rather, running along the side edge of the first endwall 18 from the bottom 12 to the top of the case 10 is a first zipper 44 that releasably secures the first sidewall 14 to the adjacent side edge of the first endwall 18. Although not illustrated in FIG. 1, a second zipper 46 (see FIG. 3) has the identical construction, running along the adjacent side edge of the second endwall 20 from the bottom 12 to the top of the case 10 to releasably secure the first sidewall 14 to the side edge of the second endwall 20. Together, the first and second zippers 44, 46 form a side closure member for the case 10, having a closed position when the zippers 44, 46 are zipped up all the way to the top, as in FIG. 1, and having an open position when the zippers 44, 46 are partly unzipped or are unzipped all the way to the bottom 12, as in FIGS. 2 and 3.

With reference now to FIG. 2, the case 10 is shown with the top flap 22 being pivoted to its open position and the zippers 44, 46 being unzipped to their open positions (the second top flap 24 is also in its open position). Accordingly, the sidewall 14 is free to move pivotally to an open position away from the endwalls 18, 20 at the top thereof. As a result, not only is there the top opening 34 providing access to the interior of the case 10, but also a side opening 48 exists through which access to the interior may be had. The top opening 34 and the side opening 48 together form a single opening larger than the top opening 34 by itself.

Advantageously, the first sidewall 14 remains connected to the first and second endwalls 18, 20 by expandable side gussets 50, 52 of a bellows or accordion file 54. An inner end 56 of the bellows file 54 is fixed within the interior of the case 10, while an outer end 58 of the bellows file 54 is affixed to, and is thus constituted by, the first sidewall 14. In between the inner and outer ends 56, 58 are a plurality of file compartment dividers 53, 60. Accordingly, when the sidewall 14 is moved to its open position, the bellows file 54 expands to enlarge the file compartments 60 and to present any papers in the file compartments 60 resting on the outwardly slanting surfaces of the dividers 53 at an angle between vertical and horizontal. The papers or folders may thus be more easily reviewed and removed from the case 10.

In accordance with an advantageous aspect of the present invention, it will be noticed that the opening of the zippers 44, 46 with the opening of the first top flap 22 is independent of the position of the second top flap 24. What this means is that the second top flap 24 can remain in its closed position while the first top flap 22 is opened and then the zippers 44, 46 are opened to permit access to the interior.

For example, suppose the user of the case 10 is on an airplane and wishes to retrieve some papers. With a conventional case, the user would have to place the case on his lap, open the top of the case and retrieve the papers through the top. If the top had flaps as in case 10, there might not be room to easily fold back the farther flap, and the case might be high enough to impede the user's view and ability to reach into the case.

In contrast, using case 10, the user can place the case 10 on his lap with the first sidewall 14 facing him. He can then fold back the first top flap 22, but need not fold back the second top flap 24. Then, he can unzip zippers 44, 46, either completely or only as much as needed to gain access to the upper interior of the file, and the first sidewall 14 will open towards him, presenting the papers in the bellows file 54 directly to his view and forward for his grasp. Accordingly, the case 10 provides significant advantages of use as compared with the cases of the prior art.

In a further embodiment, a case in accordance with the present invention will have a sidewall portion held closed by a side closure member, where the sidewall portion is only part of one of the sidewalls. The sidewall itself would be permanently attached to the endwalls, while the sidewall portion would be movable to an open position to permit access to the interior of the case. In this embodiment, the closure member can extend not only along the two side edges of the sidewall portion, but also along the top edge thereof, in the manner of complementary zippers 38 of side pocket 36 (see FIG. 1). With this construction, it would not be necessary to open the top closure member at all in order to access the interior of the case through the side opening upon opening of the side closure member, so that the papers can be reached through either the top opening, through the side opening, or both.

Many other variations in construction and arrangement of the elements are possible in accordance with the present invention. For example, the sidewall portion can be at the top of the first sidewall, so that the side opening forms a single opening with the top opening as in the first-described embodiment, but the entire first sidewall need not move. Other types of closure members, such as ties, clasps or Velcro® fasteners can be used in place of some or all of the zippers. As will be apparent to one of ordinary skill in the art, it is not necessary for the case to contain a bellows file, and side gussets can be provided, or the side gussets eliminated altogether [altogether or all together?—check]. Accessible compartments of different shapes for articles other than catalogs, file folders and papers can replace the file compartments and dividers.

While the present invention has been described with reference to the foregoing embodiments, changes and variations can be made therein which fall within the scope of the appended claims.

I claim:

1. A carrying case comprising:

a case member having a bottom, a top, two sides, two ends, first and second sidewalls extending upwardly from first and second opposite sides of said bottom, and first and second endwalls extending upwardly from third and fourth opposite sides of said bottom, wherein at least the bottom, sides and ends of said case member define a case interior;

a first top flap extending pivotally from a top edge of said first sidewall and being movable between an open position and a closed position;

a second top flap extending pivotally from a top edge of said second sidewall and being movable between an open position and a closed position, said first and second top flaps forming the top of said case member, where when said first and second top flaps are in their respective open positions, a top opening at the top of said case member permits access to the case interior of said case member, and where when said first and second top flaps are in their respective closed positions, said first and second top flaps prevent access to said case interior;

a closure member for releasably securing said first sidewall to a first side edge of said first endwall adjacent said first sidewall and to a second side edge of said second endwall adjacent said first sidewall in a closed position of said first sidewall, said closure member being movable to an open position for permitting movement of said first sidewall to an open position forming a side opening providing access to said case interior of said case member when said first top flap is in its open position, said movement of said first sidewall being permitted independently of a position of said second top flap; and a bellows file accessible through said top opening when said top flap is in its respective open position;

wherein said first sidewall forms an outer wall of the bellows file within said case interior.

2. The case of claim 1, wherein the movement of said first sidewall when said closure member is opened while said first top flap is in its open position increases access to said interior.

3. The case of claim 1, wherein when said first and second top flaps are in their respective closed positions, said first top flap overlaps said second top flap to define a closed top of said carrying case, wherein in said open position of said first top flap, said first top flap is pivoted away from said first sidewall to permit said second top flap to move to its open position, and wherein in said open position of said second top flap, said second top flap is pivoted away from said second sidewall.

4. The case of claim 1, wherein said bellows file is also accessible through said side opening when said closure member is in its open position.

5. The case of claim 4, wherein when said closure member is in its open position, when said case is upright, said bellows file constitutes slanted surfaces upon which any articles in said interior are presented at an angle between horizontal and vertical.

6. The case of claim 1, wherein said closure member in its open position, when said case is upright, constitutes a slanted surface upon which any articles in said interior are presented at an angle between horizontal and vertical.

7. The case of claim 1, wherein said top opening and said side opening together define a single opening.

8. The case of claim 1, wherein said closure member is a peripheral zipper assembly extending from said bottom along said first side edge to said top edge, and from said bottom along said second side edge to said top edge.

9. The case of claim 8, wherein said zipper assembly includes a pair of zippers.

10. The case of claim 9, wherein said pair of zippers includes a first zipper running from said bottom along said first side edge to said top edge and a second zipper running from said bottom along said second side edge to said top edge, wherein said closure means is closed when said first and second zippers are zipped up from said bottom to said top edge and said closure means is open when said first and second zippers are unzipped from said top edge to said bottom.

11. The case of claim 1, wherein said case is a briefcase.

12. A carrying case comprising:

a case member having a bottom, a sidewall portion extending upwardly at a first side of said bottom, and first and second endwalls extending upwardly from second and third opposite sides of said bottom;

a top closure member extending along a direction of a top edge of said sidewall portion and being movable between an open position forming a top opening providing access to an interior of said case member and a closed position closing said top opening;

a side closure member for releasably securing said sidewall portion along a direction of a first side edge of said first endwall adjacent said sidewall portion and along a direction of a second side edge of said second endwall adjacent said sidewall portion in a closed position of said sidewall, said side closure member being movable to an open position for permitting movement of said sidewall portion from its closed position to an open position providing access to said interior of said case member, wherein said side closure member is movable independently of a position of said top closure member; and a bellows file accessible through said top opening when said top closure member is in its respective open position;

wherein said sidewall portion forms an outer wall of the bellows file within said interior.

13. The case of claim 12, wherein the movement of said sidewall portion when said side closure member is opened while said top closure member is in its open position increases access to said interior.

14. The case of claim 12, wherein said sidewall portion is a complete sidewall extending upwardly from said first side of said bottom.

15. The case of claim 14, wherein said case further comprises a sidewall extending upwardly from a fourth side of said bottom opposite to said first side, and wherein said top closure member includes a first top flap extending pivotally from said sidewall and a second top flap extending pivotally from said sidewall portion, wherein in said closed position of said top closure member, said second side flap overlaps said first top flap to define a closed top of said carrying case, wherein in said open position of said top closure member, said first flap is pivoted away from said sidewall portion and second side flap is pivoted away from said sidewall, and wherein in a further open position of said top closure member, said first flap is pivoted away from said sidewall portion and second side flap is not pivoted away from said sidewall.

16. The case of claim 12, wherein said bellows file is also accessible through said side opening when said side closure member is in its open position.

17. The case of claim 15, wherein when said side closure member is in its open position when said case is upright, said bellows file constitutes slanted surfaces upon which any articles in said file interior are presented at an angle between horizontal and vertical.

18. The case of claim 12, wherein said side closure member in its open position, when said case is upright, constitutes a slanted surface upon which any articles in said file interior are presented at an angle between horizontal and vertical.

19. The case of claim 12, wherein said top opening and said side opening together define a single opening.

20. The case of claim 12, wherein said side closure member is a peripheral zipper assembly extending from said bottom along said first side edge to said top edge, and from said bottom along said second side edge to said top edge.

21. The case of claim 20, wherein said zipper assembly includes a pair of zippers.

22. The case of claim 21, wherein said pair of zippers includes a first zipper running from said bottom along said first side edge to said top edge and a second zipper running from said bottom along said second side edge to said top edge, wherein said side closure means is closed when said first and second zippers are zipped up from said bottom to said top edge and said side closure means is open when said first and second zippers are unzipped from said top edge to said bottom.

23. The case of claim 20, wherein the zipper assembly extends along the top edge parallel to the top closure member to define a side opening whereby opening of the zipper assembly permits the side wall portion to pivot along the first side of said bottom to provide access to the interior of the case member.

24. The case of claim 12, wherein said case is a briefcase.

* * * * *